US007619350B2

(12) United States Patent
Brock et al.

(10) Patent No.: US 7,619,350 B2
(45) Date of Patent: Nov. 17, 2009

(54) ARC DISCHARGE VESSEL HAVING ARC CENTERING STRUCTURE AND LAMP CONTAINING SAME

(75) Inventors: Lori R. Brock, Ipswich, MA (US); Warren P. Moskowitz, Ipswich, MA (US)

(73) Assignee: Osram Sylvania Inc., Danvers, MA (US)

( * ) Notice: Subject to any disclaimer, the term of this patent is extended or adjusted under 35 U.S.C. 154(b) by 534 days.

(21) Appl. No.: 11/468,131

(22) Filed: Aug. 29, 2006

(65) Prior Publication Data

US 2008/0054812 A1 Mar. 6, 2008

(51) Int. Cl.
*H01J 7/24* (2006.01)
*H01J 61/52* (2006.01)
*H01K 1/58* (2006.01)

(52) U.S. Cl. ..... 313/33; 313/20; 313/634

(58) Field of Classification Search ..... 313/623–625, 313/634–636, 493, 318.12, 570, 20, 33
See application file for complete search history.

(56) References Cited

U.S. PATENT DOCUMENTS 1,826,382 A * 10/1931 Claude ..... 315/358
1,930,132 A * 10/1933 Reger ..... 313/11
2,263,032 A * 11/1941 Farnsworth ..... 313/104
2,298,239 A * 10/1942 Stirnkorb ..... 313/611
2,367,595 A * 1/1945 Marden ..... 313/8
3,109,952 A * 11/1963 Beese ..... 313/616
3,290,538 A * 12/1966 Walsh et al. ..... 313/493
3,546,521 A * 12/1970 Gelder ..... 313/591
3,858,078 A 12/1974 Koury
3,867,660 A * 2/1975 Fohl ..... 313/12
3,900,753 A 8/1975 Richardson
4,075,529 A * 2/1978 Suga ..... 313/154
4,281,267 A * 7/1981 Johnson ..... 313/25
4,508,993 A * 4/1985 Anderson ..... 315/59
4,736,134 A * 4/1988 Lagushenko et al. ..... 313/493
4,825,125 A * 4/1989 Lagushenko et al. ..... 313/493
5,466,988 A * 11/1995 Horiuchi et al. ..... 313/35
6,104,145 A * 8/2000 Olsen et al. ..... 315/246
6,157,135 A * 12/2000 Xu et al. ..... 315/118
6,172,462 B1 1/2001 Gibson et al.
6,583,562 B1 * 6/2003 Gubbels ..... 313/625
6,836,063 B2 * 12/2004 Ishimoto et al. ..... 313/484
7,439,676 B2 * 10/2008 Walser et al. ..... 313/618
2007/0029916 A1 * 2/2007 Hendricx ..... 313/489

* cited by examiner

*Primary Examiner*—Sikha Roy
*Assistant Examiner*—Jose M Diaz
(74) *Attorney, Agent, or Firm*—Robert F. Clark

(57) ABSTRACT

An arc discharge lamp (10) has a lamp envelope (12) and an arc discharge vessel (14) mounted within the envelope (12). An arc centering structure (60) is positioned within the arc discharge vessel for substantially centering the arc. The centering structure (60) is preferably fixedly mounted within the arc discharge vessel (14) and preferably comprises a metal annulus (62) that incandesces during lamp operation and adds to the light output of the lamp. In a preferred embodiment, the lamp is suitable for vertical or horizontal operation.

6 Claims, 4 Drawing Sheets

ARC DISCHARGE VESSEL HAVING ARC CENTERING STRUCTURE AND LAMP CONTAINING SAME

TECHNICAL FIELD

This invention relates to arc discharge lamps and more particularly to such lamps having a stabilized arc.

BACKGROUND OF THE INVENTION

Arc discharge lamps, and in particular metal halide lamps, are frequently employed in commercial usage because of their high luminous efficacy and long life. A typical metal halide arc discharge lamp includes an arc discharge vessel made from quartz or fused silica or a ceramic such as polycrystalline alumina that is hermetically sealed within a borosilicate glass outer envelope. The arc discharge vessel, itself hermetically sealed, has tungsten electrodes sealed into opposite ends and contains a fill material including mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps and lamps with ceramic arc discharge vessels, the outer envelope is evacuated.

The arc in a standard metal halide lamp that is operated horizontally bows upward due to convection, thus the arc is not centered within the arc discharge vessel but is raised toward the upper wall. This condition raises the temperature of the arc discharge vessel material that is nearest to the arc. The overheated upper arc discharge vessel wall results in reduced lamp life. Additionally, a bowed arc makes it difficult to focus in applications where optics are important.

It has been proposed to alleviate this problem by bowing the arc discharge vessel to approximate the shape that the arc will take. This latter technique is exemplified in U.S. Pat. No. 3,858,078. While this solution works well and has been in use for many years, the lamp employing a curved arc discharge vessel is limited to horizontal operation and must have a special socket with a particular orientation to insure that the bowed portion of the arc discharge vessel is upward when installation is complete. Additionally, it has been found to be difficult if not impossible to utilize the bowed arc discharge vessel design in two-piece, injection molded ceramic arc discharge vessels because the curved shape would not permit removal from the mold, This is unfortunate because the ceramic arc discharge vessel has many advantages over the quartz type and it would be desirable to use such arc discharge vessels in horizontally operated lamps.

Another technique for straightening the arc employs specialized, acoustic ballasts; however, these ballasts are more complicated than and more expensive than standard metal halide ballasts. A further problem with these acoustic ballasts is that they can have a detrimental effect on the stability of the lamp operation. These ballasts are often used with mercury-free metal halide lamps; however, removing mercury causes a voltage drop that makes it is necessary to increase the arc length. Without the acoustics however, the mercury-free arcs are less stable than the shorter, mercury-containing arcs.

SUMMARY OF THE INVENTION

It is, therefore, an object of the invention to obviate the disadvantages of the prior art.

It is another object of the invention to enhance the operation of arc discharge lamps, in particular metal halide lamps.

These objects are accomplished, in one aspect of the invention by an arc discharge lamp having a lamp envelope and an arc discharge vessel mounted within said envelope; the arc discharge vessel containing an arc centering structure within the arc discharge vessel for substantially centering an arc. Preferably, the arc centering structure is fixedly mounted within said arc discharge vessel.

In a preferred embodiment, lamps so constructed have a centered arc regardless of lamp orientation.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
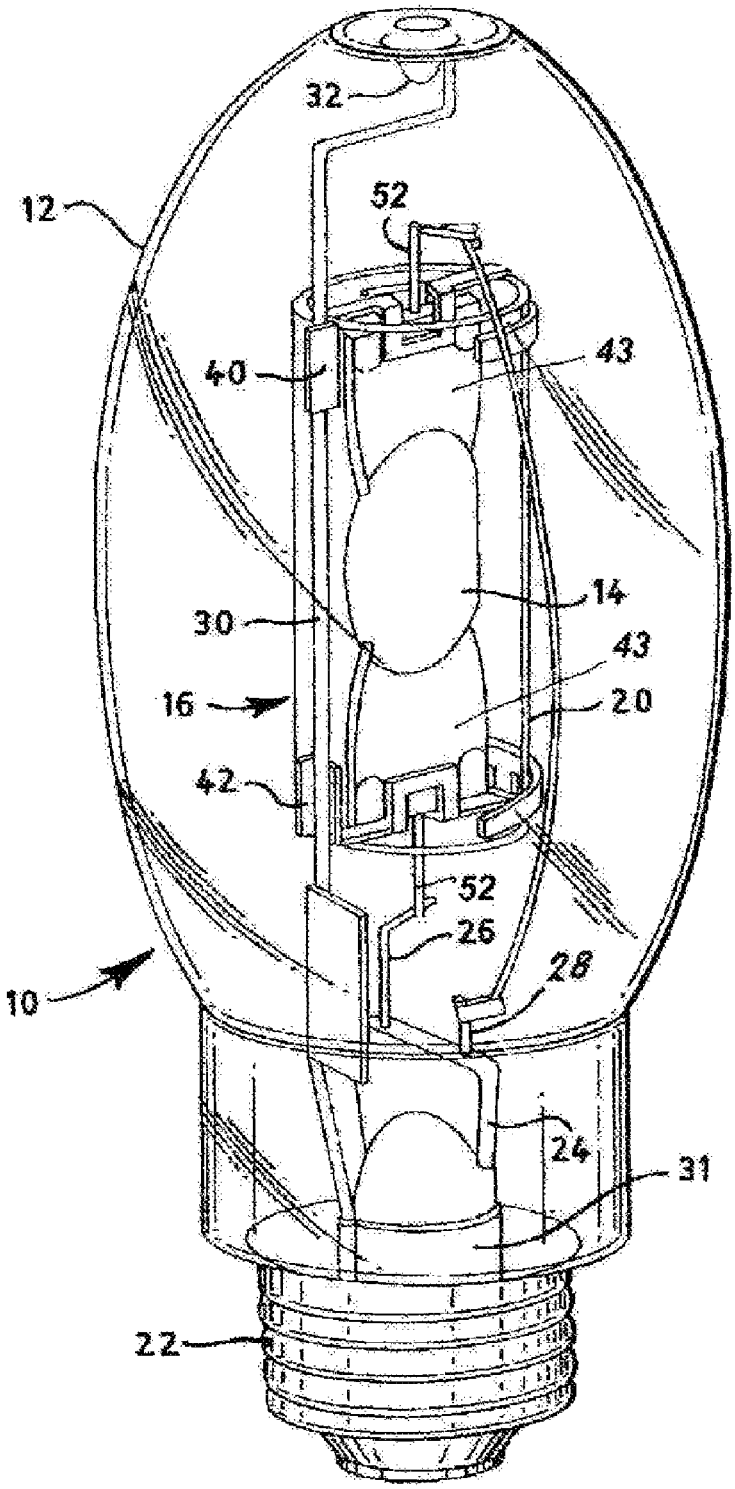
FIG. 1 is a perspective view of an arc discharge lamp.

Referring now to the drawings with greater particularity, there is shown in FIG. 1 a metal halide arc discharge lamp 10 including a lamp envelope 12 and an arc discharge vessel 14 mounted within the envelope by mounting frame 16. The arc discharge vessel may be positioned within a shroud 20 which can also be supported by the mounting frame 16. Electrical energy is coupled to the arc discharge vessel 14 through a base 22, a lamp stem 24 and electrical leads 26 and 28. The arc discharge vessel contains a chemical fill or dose of materials to provide light when an arc is initiated therein, as is known. The shroud 20 comprises a cylindrical tube of light transmissive, heat resistant material such as quartz.

As noted, in this particular instance, the mounting frame 16 supports both the arc discharge vessel 14 and the shroud 20 within the lamp envelope 12. The mounting frame 16 includes a metal support rod 30 attached to lamp stem 24 by a strap 31. The support rod engages an inward projection 32 in the upper end of the lamp envelope 12. The support rod 30 in its central portion is parallel to a central axis of the arc discharge vessel 14 and shroud 20. The mounting means 16 further includes an upper clip 40 and a lower clip 42, which secure both arc discharge vessel 14 and shroud 20 to support rod 30. The clips 40 and 42 are attached to the support rod 30, preferably by welding.

Figure 2:
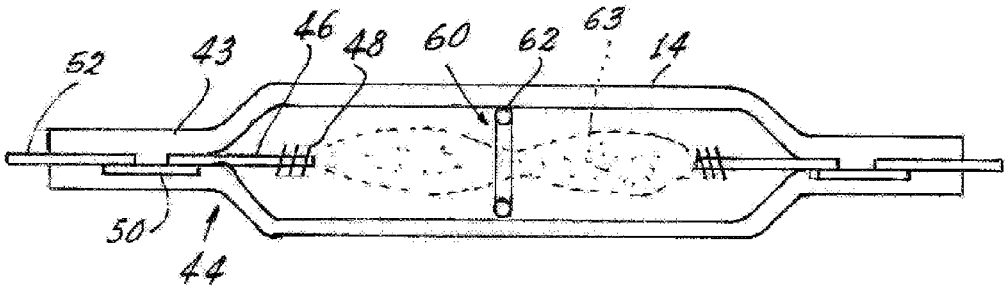
FIG. 2 is a sectional view of an arc discharge vessel employing an embodiment of the invention.

Positioned in a sealed manner at press-seal ends 43 of the arc discharge vessel 14 are electrode assemblies 44 as shown in FIG. 2. Each electrode assembly 44 comprises an electrode 46 of a suitable material, such as tungsten, and may a have coil 48 attached to one end thereof, internally of the arc discharge vessel; a molybdenum sealing foil 50 attached to the other end of the electrode; and an in-lead 52 attached to the opposite end of the molybdenum sealing foil and extending externally of the arc discharge vessel for making electrical connection thereto. One of the in-leads 52 is connected to electrical lead 26 and one is connected to electrical lead 28.

The mounting assembly described above is exemplary and is not meant to limit the invention, many other mounting assembles being known and employed in arc discharge lamps.

Referring now with more particularity to FIG. 2, there is shown an arc discharge vessel 14 having sealed ends 43 containing electrode assemblies 44. The assemblies 44 comprise an in-lead, for example 52, a molybdenum foil 50 and an electrode 46 which can have a coil 48 affixed to the internal end thereof. Such electrode assemblies are common in quartz or fused silica arc discharge vessels.

Structure 60 for centering the arc is provided within the arc discharge vessel 14 and can comprise a tungsten wire annulus 62, which causes the arc (shown diagrammatically at 63) to remain centered even when the arc lamp 10 is operated horizontally.

Figure 3:
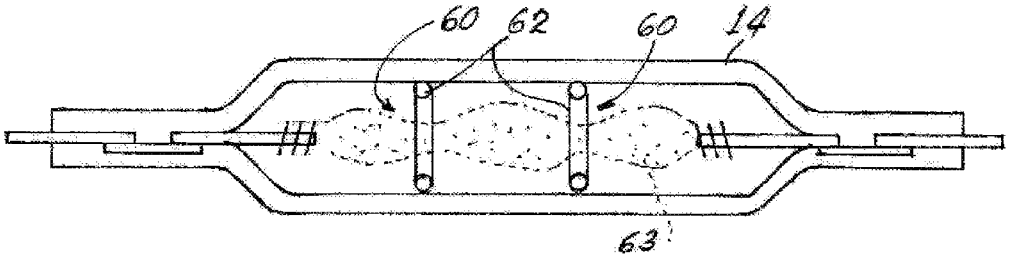
FIG. 3 is a similar view of an alternate embodiment of the invention.

As shown in FIG. 3, multiple centering structures 60 can be provided, preferably evenly spaced along the arc axis.

Figure 4:
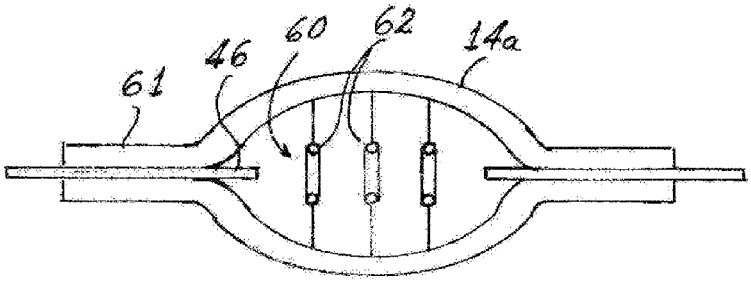
FIG. 4 is a similar view of yet another embodiment of the invention.

Referring now to FIG. 4 there is shown a "bulgy" ceramic arc discharge vessel 14*a* having capillary ends 61 containing electrodes 46 that are sealed in the ends 61 by frit, as is known. Positioned within the arc discharge vessel 14*a* there are three centering structures 60 in the form of annuli 62.

Figure 5:
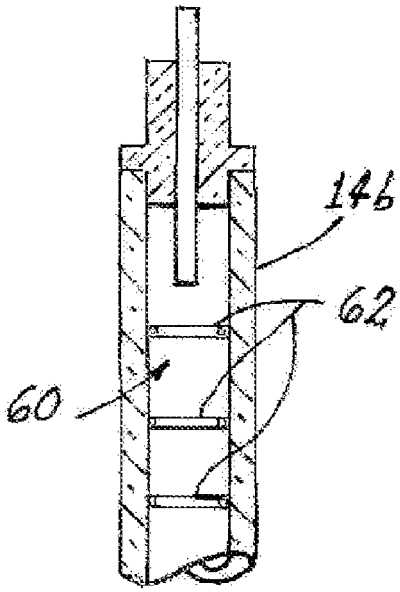
FIG. 5 is a similar view of still another embodiment of the invention.

The centering structures 60 are equally applicable in cylindrical ceramic arc discharge vessels 14*b*, such as shown in FIG. 5.

The centering structures 60 can take many forms as shown in FIGS. 6-8 and 11-14.

Figure 6:
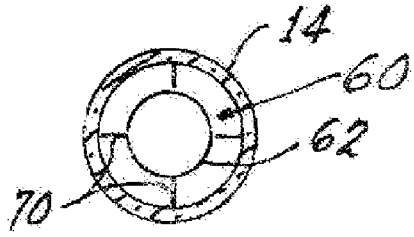
FIG. 6 is a cross-sectional view of one embodiment of a centering structure.

Referring particularly to FIG. 6, the centering structure 60 comprises an annulus 62 provided with a number of mounting fingers 70 that contact the inner wall of the arc discharge vessel 14 or 14*a*.

Figure 7:
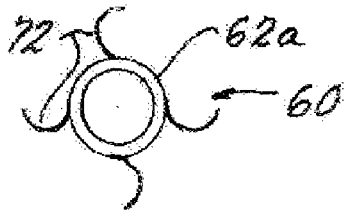
FIG. 7 is an elevational view of an alternate centering structure.

An alternate embodiment of an annulus 62*a* is shown in FIG. 7 wherein tensioned fingers 72 are provided. The employment of tensioned fingers 72 is ideally suited to use within a ceramic arc discharge vessel when the annulus or annuli are positioned within the arc discharge vessel before sintering. Since the sintering operation causes some shrinkage of the arc discharge vessel the tensioned fingers 72 accommodate this shrinkage.

Figure 8:
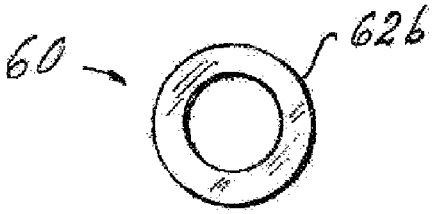
FIG. 8 is an elevational view of still another centering structure.

In addition to the annuli 62 and 62*a*, which can be circular in cross-section, the centering structure 60 can take the form of a "washer" 62*b* as shown in FIG. 8 wherein the cross-section would be rectangular.

Figure 11:
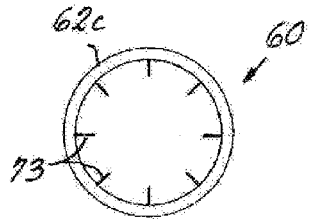
FIG. 11 is an elevational view of another centering structure.
Figure 12:
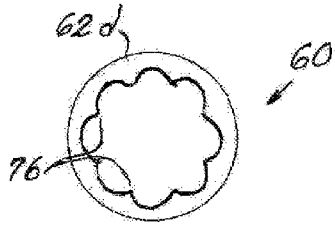
FIG. 12 is an elevational view of another embodiment of a centering structure.
Figure 13:
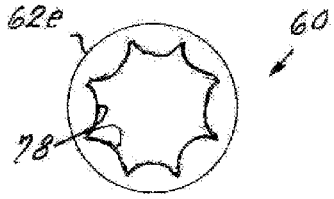
FIG. 13 is an elevational view of still another embodiment of a centering structure.

Additional non-limiting variants are shown in FIGS. 11-13 wherein the centering structure 60 takes the form of an annulus 62*c* having a plurality of inwardly projecting fingers 73 (FIG. 11), an annulus 62*d* that can be stamped from sheet material and having a central aperture defined by a plurality of cusps 76 (FIG. 12), an annulus 62*e* that also can be stamped from sheet material and having an a central aperture defined by a plurality of semi-circles 78 (FIG. 13).

Figure 9:
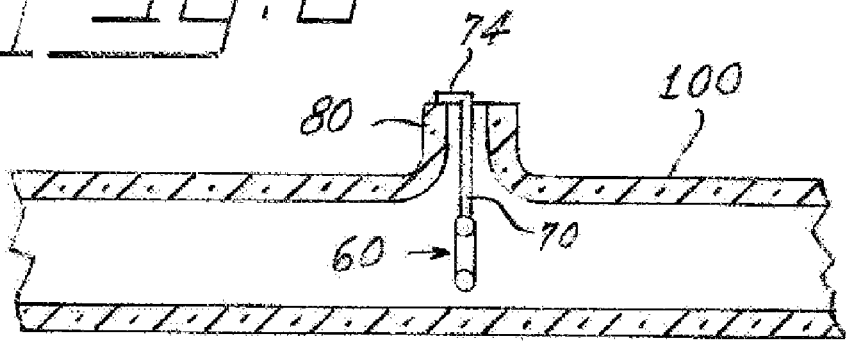
FIG. 9 is an illustration of one method for inserting a centering structure.

Various methods are possible for assembling the arc discharge vessels and arc centering structures. For example, one such method is shown in FIG. 9 wherein an arc discharge vessel blank 100 of quartz has a filling and exhaust tubulation 80. A centering structure 60 having a finger 70 attached is fed into an open end of the blank 100 until a terminus 74 of the finger 70 projects through the tubulation 80. The terminus 74 is bent in a substantially right angle to be held in position and the blank 100 is finished normally into an arc discharge vessel 14 by inserting electrode assemblies 44, forming the seals 43 and exhausting, filling and sealing the exhaust tubulation.

Alternatively, the tubulation 80 can be sealed about the finger 70 to absolutely maintain the centering structure 60 in its desired position and a separate exhaust and filling tubulation can be provided for those functions.

Figure 10:
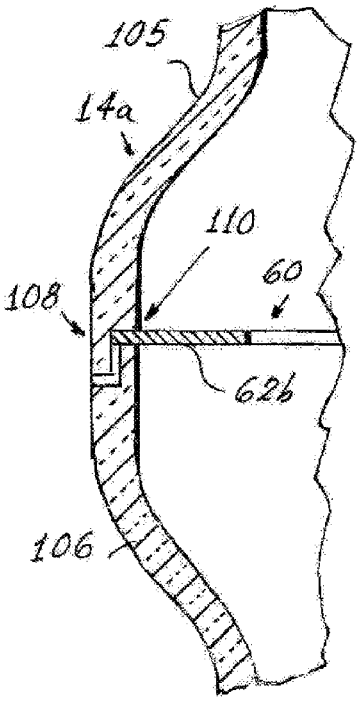
FIG. 10 is a partial cross-sectional view of another method of inserting a centering structure.

Still another method is shown in FIG. 10, which is applicable in the case of ceramic arc discharge vessels when only a single centering structure 60 is to be provided. Arc discharge vessels may be formed by molding two hemispherical halves 105, 106 having a ship lap joint 108 that is used to join the two halves. By providing a gap 110 between the halves a centering structure, for example, a washer-type 62*b*, can be sealed between the halves. Alternatively, the fingers 70 of a centering structure 60 in the form of an annulus 62 could be sealed within the gap 110.

Figure 14:
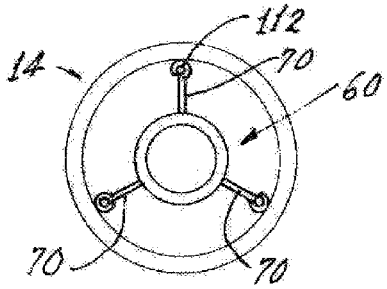
FIG. 14 is a sectional view of another mounting method.

Yet another method is illustrated in FIG. 14 wherein the centering structures 60 (one or more) could be fixed between a plurality of ceramic rods 112, for example, by having the terminal ends of fingers 70 wrapped about the rods. The latter method is ideally suited to arc discharge vessels having a cylindrical configuration.

In a specific example, a quartz arc discharge vessel having an inside diameter of 19.5 mm had two centering structures 60 (FIG. 3), comprised of two 7.7 mm outside diameter rings, made from 0.74 mm tungsten wire, placed 1.15 cm above and below the middle of the arc discharge vessel. Tungsten is preferred because its melting temperature is 3410° C.

During testing the arc is seen to constrict as it flows through the rings, raising their temperature to 2100 K.

In a second embodiment shown in FIG. 2 a single centering structure 60 was employed. The single centering structure had a 10 mm OD and was formed from tungsten wire having a 0.74 mm diameter. The single centering structure was centrally mounted within the arc discharge vessel and produced constriction in the arc. The structure temperature was 1860 K. The temperatures of the centering structures can be controlled by changing the diameters of the structures or the thickness of the materials from which they are made. For the arc discharge vessel 14 shown in FIG. 3 the centering structures were found to radiate approximately 10 watts of light each, with the color output being in the red portion of the spectrum.

In the examples illustrated above each arc discharge vessel had a filling of 33 torr argon, 50.7 mg mercury, 5.0 mg mercury iodide ($HgI_2$), 0.5 mg scandium and 20.7 mg sodium iodide (NaI).

In addition to tungsten or tungsten doped with thoria, other high melting point metals such as molybdenum or tantalum or alloys thereof can be utilized. Also, the centering function can be achieved with use of high temperature resistant carbides, nitrides or other ceramics.

While there have been shown and described what are at present considered to be the preferred embodiments of the invention, it will be apparent to those skilled in the art that various changes and modifications can be made herein without departing from the scope of the invention as defined by the appended claims.

We claim:

1. An arc discharge vessel having at least one arc centering structure and containing an arc when the lamp is operating, the arc passing through the at least one arc centering structure which acts to substantially center the arc in the arc discharge vessel and wherein the at least one arc centering structure comprises an annulus having a plurality of inwardly projecting fingers.

2. The arc discharge vessel of claim 1 wherein the annulus is comprised of a metal selected from tungsten, molybdenum, tantalum or alloys thereof and has one or more mounting fingers which contact a wall of the arc discharge vessel.

3. An arc discharge vessel having at least one arc centering structure and containing an arc when the lamp is operating, the arc passing through the at least one arc centering structure which acts to substantially center the arc in the arc discharge vessel and wherein the at least one arc centering structure comprises an annulus having a central aperture defined by a plurality of cusps.

4. The arc discharge vessel of claim 3 wherein the annulus is comprised of a metal selected from tungsten, molybdenum, tantalum or alloys thereof and has one or more mounting fingers which contact a wall of the arc discharge vessel.

5. An arc discharge vessel having at least one arc centering structure and containing an arc when the lamp is operating, the arc passing through the at least one arc centering structure which acts to substantially center the arc in the arc discharge vessel and wherein the at least one arc centering structure comprises an annulus having a central aperture defined by a plurality of semi-circles.

6. The arc discharge vessel of claim 5 wherein the annulus is comprised of a metal selected from tungsten, molybdenum, tantalum or alloys thereof and has one or more mounting fingers which contact a wall of the arc discharge vessel.

* * * * *